US007842180B1

(12) United States Patent
Leonard et al.

(10) Patent No.: US 7,842,180 B1
(45) Date of Patent: Nov. 30, 2010

(54) HYDROCRACKING PROCESS

(75) Inventors: Laura E. Leonard, Oak Park, IL (US); Peter Kokayeff, Naperville, IL (US)

(73) Assignee: UOP LLC, Des Plaines, IL (US)

( * ) Notice: Subject to any disclaimer, the term of this patent is extended or adjusted under 35 U.S.C. 154(b) by 1020 days.

(21) Appl. No.: 11/300,007

(22) Filed: Dec. 14, 2005

(51) Int. Cl.
*C10G 47/00* (2006.01)
*C10G 49/00* (2006.01)
*C10G 49/22* (2006.01)
*C10G 45/02* (2006.01)

(52) U.S. Cl. ..... 208/107; 208/49; 208/100; 208/209; 208/254 H

(58) Field of Classification Search ..... 208/46, 208/49, 58, 60, 85, 88, 89, 95, 100, 177, 208/208 R, 209, 211, 212, 254 R, 107, 108, 208/254 H See application file for complete search history.

(56) References Cited

U.S. PATENT DOCUMENTS

| | | | | |
|---|---|---|---|---|
| 3,328,290 A | | 6/1967 | Hengstebeck | 208/89 |
| 5,403,469 A | | 4/1995 | Vauk et al. | 208/78 |
| 5,720,872 A | | 2/1998 | Gupta | 208/57 |
| 5,904,835 A | * | 5/1999 | Thakkar | 208/78 |
| 5,980,729 A | | 11/1999 | Kalnes et al. | 208/89 |
| 6,106,694 A | | 8/2000 | Kalnes et al. | 208/57 |
| 6,123,835 A | | 9/2000 | Ackerson et al. | 208/213 |
| 6,428,686 B1 | | 8/2002 | Ackerson et al. | 208/213 |

OTHER PUBLICATIONS

U.S. Appl. No. 11/460,307 filed Jul. 27, 2006, Leonard.
U.S. Appl. No. 11/618,623 filed Dec. 29, 2006, Kokayeff.
U.S. Appl. No. 11/872,140 filed Oct. 15, 2007, Kokayeff.
U.S. Appl. No. 11/872,102 filed Oct. 15, 2007, Kokayeff.
U.S. Appl. No. 11/872,084 filed Oct. 15, 2007, Leonard.
U.S. Appl. No. 11/872,251 filed Oct. 15, 2007, Kokayeff.
U.S. Appl. No. 11/872,312 filed Oct. 15, 2007, Kokayeff.
U.S. Appl. No. 12/165,444 filed Jun. 30, 2008, Petri.
U.S. Appl. No. 12/165,499 filed Jun. 30, 2008, Kokayeff.
U.S. Appl. No. 12/165,522 filed Jun. 30, 2008, Kokayeff.
U.S. Appl. No. 12/495,574 filed Jun. 30, 2009, Petri.
U.S. Appl. No. 12/495,601 filed Jun. 30, 2009, Petri.
Office Action dated Jun. 4, 2009 in U.S. Appl. No. 11/460,307, Leonard.
Applicants' Sep. 4, 2009 Response to the Jun. 4, 2009 Office Action in U.S. Appl. No, 11/460,307, Leonard.
Office Action dated Jun. 12, 2009 in U.S. Appl. No. 11/618,623, Kokayeff.
Applicants' Sep. 11, 2009 Response to the Jun. 12, 2009 Office Action in U.S. Appl. No. 11/618,623, Kokayeff.
Office Action dated Dec. 15, 2009 in U.S. Appl. No. 11/872,084, Leonard.
Applicants' Mar. 15, 2010 Response to the Dec. 15, 2009 Office Action in U.S. Appl. No. 11/872,084, Leonard.
Office Action dated Oct. 5, 2009 in U.S. Appl. No. 11/872,0312, Kokayeff.
Applicants' Jan. 5, 2010 Response to the Oct. 5, 2009 Office Action in U.S. Appl. No, 11/872,312, Kokayeff.
Office Action dated Apr. 12, 2010 in U.S. Appl. No. 11/872,312, Kokayeff.
Applicants' Jul. 1, 2010 Response to the Apr. 12, 2010 Office Action in U.S. Appl. No. 11/872,312, Kokayeff.
U.S. Appl. No. 12/704,780 filed Feb. 12, 2010, Kokayeff.

* cited by examiner

*Primary Examiner*—Glenn Caldarola
*Assistant Examiner*—Randy Boyer
(74) *Attorney, Agent, or Firm*—James C Paschall

(57) ABSTRACT

A hydrocracking process wherein a liquid phase stream comprising a hydrocarbonaceous feedstock and a liquid phase effluent from a hydrocracking zone and a sufficiently low hydrogen concentration to maintain a liquid phase continuous system into a hydrotreating zone. A portion of the effluent from the hydrotreating zone comprising unconverted hydrocarbons is introduced into the hydrocracking zone with a sufficiently low hydrogen concentration to maintain a liquid phase continuous system.

18 Claims, 1 Drawing Sheet

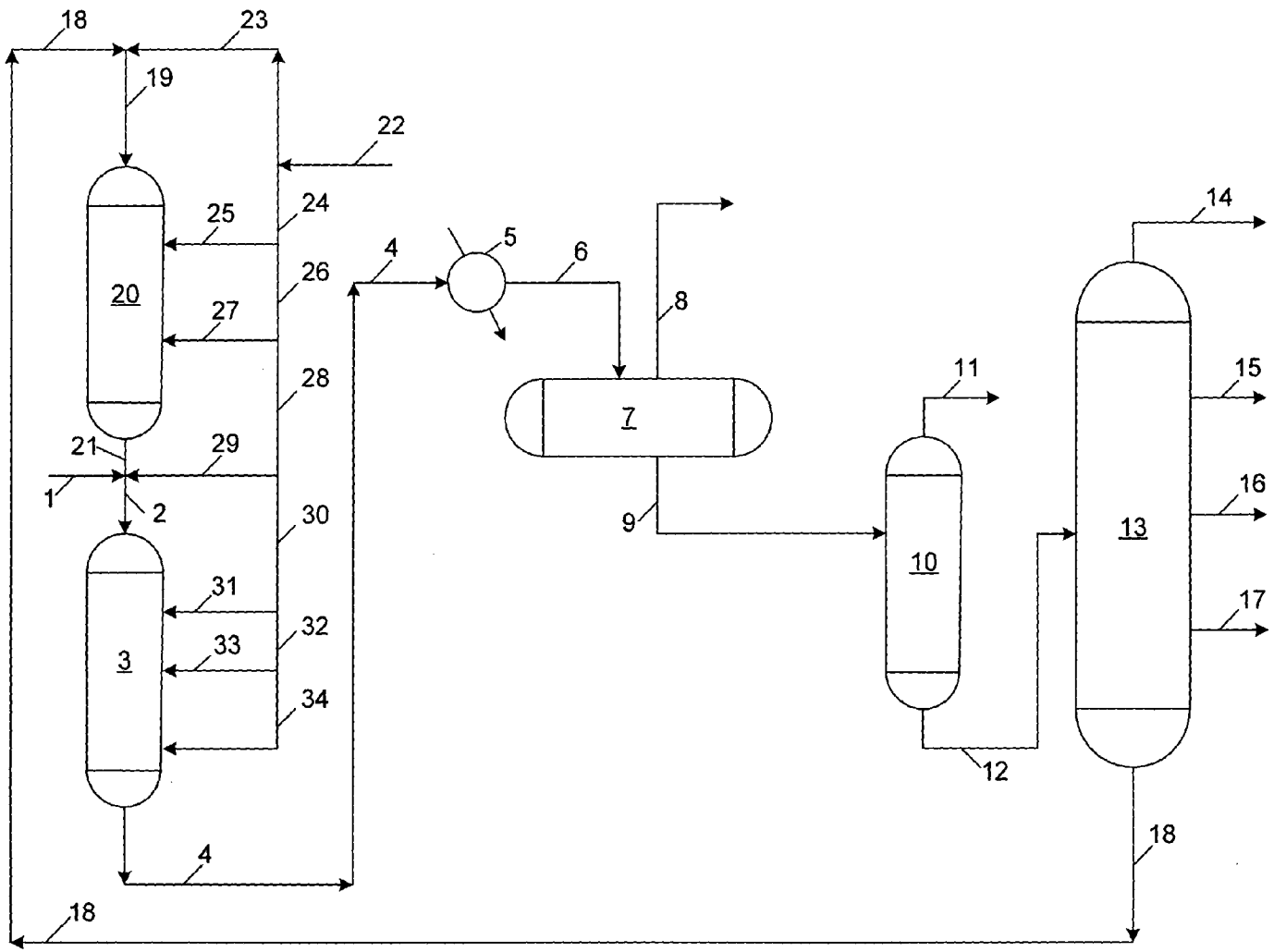
14
15
16
17
13
18
11
10
12
8
7
9
6
5
4
22
24
26
28
30
32
34
23
25
27
29
31
33
19
20
2
3
21
1
18
18

HYDROCRACKING PROCESS

FIELD OF THE INVENTION

The field of art to which this invention pertains is the catalytic conversion of hydrocarbons to useful hydrocarbon products. More particularly, the invention relates to catalytic hydrocracking.

BACKGROUND OF THE INVENTION

The present invention pertains to the hydrocracking of a hydro-carbonaceous feedstock. Petroleum refiners often produce desirable products such as turbine fuel, diesel fuel and other products known as middle distillates as well as lower boiling hydrocarbonaceous liquids such as naphtha and gasoline by hydrocracking a hydrocarbon feedstock derived from crude oil or heavy fractions thereof. Feedstocks most often subjected to hydrocracking are gas oils and heavy gas oils recovered from crude oil by distillation. A typical heavy gas oil comprises a substantial portion of hydrocarbon components boiling above about 371° C. (700° F.), usually at least about 50 percent by weight boiling above 371° C. (700° F.). A typical vacuum gas oil normally has a boiling point range between about 315° C. (600° F.) and about 565° C. (1050° F.).

Hydrocracking is generally accomplished by contacting in a hydro-cracking reaction vessel or zone the gas oil or other feedstock to be treated with a suitable hydrocracking catalyst under conditions of elevated temperature and pressure in the presence of hydrogen as a separate phase in a two-phase reaction zone so as to yield a product containing a distribution of hydrocarbon products desired by the refiner. The operating conditions and the hydrocracking catalysts within a hydrocracking reactor influence the yield of the hydrocracked products.

Traditionally, the fresh feedstock for a hydrocracking process is first introduced into a denitrification and desulfurization zone having hydrogen in a gaseous phase and particularly suited for the removal of sulfur and nitrogen contaminants and subsequently introduced into a hydrocracking zone containing hydrocracking catalyst and having hydrogen in a gaseous phase. Another method of hydrocracking a fresh feedstock is to introduce the fresh feedstock and the effluent from the hydrocracking zone into the denitrification and desulfurization zone. The resulting effluent from the hydrocracking zone is separated to produce desired hydrocracked products and unconverted feedstock which is then introduced into the hydrocracking zone. Previously, at least a major portion of the hydrogen present in reaction zones was present in a gaseous phase.

Although a wide variety of process flow schemes, operating conditions and catalysts have been used in commercial activities, there is always a demand for new hydrocracking methods which provide lower costs, ease of construction, higher liquid product yields and higher quality products.

INFORMATION DISCLOSURE

U.S. Pat. No. 5,720,872 B1 (Gupta) discloses a process for hydroprocessing liquid feedstocks in two or more hydroprocessing stages which are in separate reaction vessels and wherein each reaction stage contains a bed of hydroprocessing catalyst. The liquid product from the first reaction stage is sent to a low pressure stripping stage and stripped of hydrogen sulfide, ammonia and other dissolved gases. The stripped product stream is then sent to the next downstream reaction stage, the product from which is also stripped of dissolved gases and sent to the next downstream reaction stage until the last reaction stage, the liquid product of which is stripped of dissolved gases and collected or passed on for further processing. The flow of treat gas is in a direction opposite the direction in which the reaction stages are staged for the flow of liquid. Each stripping stage is a separate stage, but all stages are contained in the same stripper vessel.

U.S. Pat. No. 3,328,290 B1 (Hengstebeck) discloses a two-stage process for the hydrocracking of hydrocarbons in which the feed is pretreated in the first stage.

U.S. Pat. No. 5,403,469 B1 (Vauk et al) discloses a parallel hydrotreating and hydrocracking process. Effluent from the two processes are combined in the same separation vessel and separated into a vapor comprising hydrogen and a hydrocarbon-containing liquid. The hydrogen is shown to be supplied as part of the feed streams to both the hydrocracking and the hydrotreater.

U.S. Pat. No. 5,980,729 (Kalnes et al) discloses a hydrocracking process wherein a hydrocarbonaceous feedstock and a hot hydrocracking zone effluent containing hydrogen is passed to a denitrification and desulfurization reaction zone to produce hydrogen sulfide and ammonia to thereby clean up the fresh feedstock. The resulting hot, uncooled effluent from the denitrification and desulfurization zone is hydrogen stripped in a stripping zone maintained at essentially the same pressure as the preceding reaction zone with a hydrogen-rich gaseous stream to produce a vapor stream comprising hydrogen, hydrocarbonaceous compounds boiling at a temperature below the boiling range of the fresh feedstock, hydrogen sulfide and ammonia, and a liquid hydro-carbonaceous stream containing unconverted feedstock. This liquid hydrocarbonaceous stream is introduced into a hydrocracking zone to produce a hydrocracking zone effluent which then joins the fresh feedstock as described hereinabove and is subsequently introduced into the denitrification and desulfurization zone.

U.S. Pat. No. 6,106,694 (Kalnes et al) discloses a hydrocracking process wherein a hydrocarbonaceous feedstock and a hot hydrocracking zone effluent is passed to a denitrification and desulfurization reaction zone to produce hydrogen sulfide and ammonia to thereby clean up the fresh feedstock. The resulting hot, uncooled effluent from the denitrification and desulfurization zone is hydrogen stripped in a stripping zone maintained at essentially the same pressure as the preceding reaction zone with a hydrogen-rich gaseous stream to produce a vapor stream comprising hydrogen, hydrocarbonaceous compounds boiling at a temperature below the boiling range of the fresh feedstock, hydrogen sulfide and ammonia, and a liquid hydrocarbonaceous stream containing unconverted feedstock. This liquid hydrocarbonaceous stream is subsequently introduced into the hydrocracking zone to produce an effluent which is subsequently introduced into the denitrification and desulfurization reaction zone as described hereinabove.

U.S. Pat. No. 6,123,835 (Ackerson et al.) and U.S. Pat. No. 6,428,686 B1 (Ackerson et al.) disclose a hydro process where the need to circulate hydrogen through the catalyst is eliminated by mixing the hydrogen and the oil feedstock in the presence of a diluent in which the hydrogen solubility is high relative to the feedstock. The oil/diluent/hydrogen solution can then be fed to a plug flow reactor containing catalyst.

BRIEF SUMMARY OF THE INVENTION

The present invention is a catalytic hydrocracking process wherein a liquid phase stream comprising a hydrocarbonaceous feedstock, a liquid phase effluent from a hydrocracking zone, and a sufficiently low hydrogen concentration to maintain a liquid phase continuous system are fed into a hydrotreating zone to produce hydrogen sulfide and ammonia, and provide a first hydrocarbonaceous stream comprising hydrocarbons having a reduced level of sulfur and nitrogen. The resulting effluent stream from the hydrotreating zone is passed to a heat exchanger to cool the effluent stream and provide a vapor stream comprising hydrogen sulfide, ammonia and normally gaseous hydrocarbons and a second hydrocarbonaceous stream. In a preferred embodiment the second hydrocarbonaceous stream is separated in a second vapor liquid separator to provide a second vapor stream comprising normally gaseous hydrocarbons and a third hydrocarbonaceous stream. At least a portion of the second or third hydrocarbonaceous stream provides an unconverted hydrocarbon stream boiling in the range of the hydrocarbonaceous feedstock which stream is introduced into the hydrocracking zone to produce hydrocracked hydrocarbons boiling in a temperature range lower than the hydrocarbonaceous feedstock.

Conventional hydroprocessing operations utilize trickle bed technology. This technology necessitates the use of large amounts of hydrogen relative to the hydrocarbon feedstock, sometimes exceeding 1685 $nm^3/m^3$ (10,000 SCF/B), and requires the use of costly recycle gas compression. The large amounts of hydrogen relative to the hydrocarbon feedstock in conventional hydroprocessing operations renders this type of operation a gas phase continuous system. It has been discovered that it is neither economical nor necessary to have this large excess of hydrogen to effect the desired conversion. The desired conversion can be effected with much less hydrogen, and can be economically and efficiently performed with only sufficient hydrogen to ensure a liquid phase continuous system. A liquid phase continuous system would exist at one extreme with only sufficient hydrogen to fully saturate the hydrocarbon feedstock and at the other extreme where sufficient hydrogen is added to transition to a gas phase continuous system. The amount of hydrogen that is added between these two extremes is dictated by economic considerations. Operation with a liquid phase continuous system avoids the high costs associated with a recycle gas compressor.

Other embodiments of the present invention encompass further details such as types and descriptions of feedstocks, hydrocracking catalysts, hydrotreating catalysts, and preferred operating conditions including temperatures and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not be a limitation thereof. While the drawing depicts the process as operating in a downflow mode it is presented for illustrative purposes and is not intended to exclude the upflow mode of operation.

DETAILED DESCRIPTION OF THE INVENTION

The process of the present invention is particularly useful for hydrocracking a hydrocarbon oil containing hydrocarbons and/or other organic materials to produce a product containing hydrocarbons and/or other organic materials of lower average boiling point and lower average molecular weight.

The hydrocarbon feedstocks that may be subjected to hydrocracking by the method of the invention include all mineral oils and synthetic oils (e.g., shale oil, tar sand products, etc.) and fractions thereof. Illustrative hydrocarbon feedstocks include those containing components boiling above 288° C. (550° F.), such as atmospheric gas oils, vacuum gas oils, deasphalted, vacuum, and atmospheric residua, hydrotreated or mildly hydrocracked residual oils, coker distillates, straight run distillates, solvent-deasphalted oils, pyrolysis-derived oils, high boiling synthetic oils, cycle oils and cat cracker distillates. A preferred hydrocracking feedstock is a gas oil or other hydrocarbon fraction having at least 50% by weight, and most usually at least 75% by weight, of its components boiling at a temperature above about 288° C. (550° F.). One of the most preferred gas oil feedstocks will contain hydrocarbon components which boil above 288° C. (550° F.) with best results being achieved with feeds containing at least 25 percent by volume of the components boiling between 315° C. (600° F.) and 565° C. (1050° F.).

The selected hydrocarbonaceous feedstock and hydrogen are introduced into a hydrotreating reaction zone at hydrotreating reaction conditions. In addition, the resulting effluent from a hereinafter described hydrocracking reaction zone is also introduced into the hydrotreating reaction zone. Preferred hydrotreating reaction conditions include a temperature from about 204° C. (400° F.) to about 482° C. (900° F.), a pressure from about 3.5 MPa (500 psig) to about 17.3 MPa (2500 psig), a liquid hourly space velocity of the fresh hydrocarbonaceous feedstock from about 0.1 $hr^{-1}$ to about 10 $hr^{-1}$ with a hydrotreating catalyst or a combination of hydrotreating catalysts. Only enough hydrogen is introduced into the hydrotreating reaction zone to maintain a liquid phase continuous system. This means that in contrast to conventional hydroprocessing processes which operate in trickle bed mode in which it is the gas phase that is continuous the present invention operates in a liquid phase continuous system.

The term "hydrotreating" as used herein refers to a process wherein a hydrogen-containing treat gas absorbed in the liquid hydrocarbon is used in the presence of suitable catalysts which are primarily active for the removal of heteroatoms, such as sulfur and nitrogen from the hydrocarbon feedstock. Suitable hydrotreating catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. It is within the scope of the present invention that more than one type of hydrotreating catalyst be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent.

The resulting effluent from the hydrotreating reaction zone is preferably cooled to a temperature in the range from about 4.4° C. (40° F.) to about 60° C. (140° F.) and introduced into a vapor-liquid separator preferably operated at a pressure from about 3.5 MPa (500 psig) to about 17.3 MPa (2500 psig) to provide a vapor stream comprising hydrogen, hydrogen sulfide, ammonia and normally gaseous hydrocarbons, and a hydrocarbonaceous stream comprising hydrocarbons having a reduced level of sulfur and nitrogen.

In a preferred embodiment, the hydrocarbonaceous stream comprising hydrocarbons having a reduced level of sulfur and nitrogen provided by the previous vapor-liquid separator is introduced into a subsequent vapor-liquid separator operated at a lower pressure to flash any additional normally gaseous hydrocarbons. The resulting liquid hydrocarbonaceous stream from the second vapor-liquid separator is separated, preferably by fractionation, to provide desired product streams such as for example gasoline and diesel and a high boiling hydrocarbonaceous stream comprising unconverted hydrocarbons boiling in the range of the hydrocarbonaceous feedstock.

At least a portion of the liquid hydrocarbonaceous stream recovered from the second vapor-liquid separator and containing hydrocarbonaceous compounds boiling at a temperature greater than about 343° C. (650° F.) is introduced into a hydrocracking zone along with added hydrogen in an amount sufficiently low to maintain a liquid phase continuous system. The hydrocracking zone may contain one or more beds of the same or different catalyst. In one embodiment, when the preferred products are middle distillates, the preferred hydrocracking catalysts utilize amorphous bases or low-level zeolite bases combined with one or more Group VIII or Group VIB metal hydrogenating components. In another embodiment, when the preferred products are in the gasoline boiling range, the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). It is preferred to employ zeolites having a relatively high silica/alumina mole ratio between about 3 and 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms ($10^{-10}$ meters), wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006 B1.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 371°-648° C. (700°-1200° F.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 B1 (Klotz).

The hydrocracking of the hydrocarbonaceous feedstock in contact with a hydrocracking catalyst is conducted in the presence of sufficiently low concentrations of hydrogen to maintain a liquid phase continuous system and preferably at hydrocracking reactor conditions which include a temperature from about 232° C. (450° F.) to about 468° C. (875° F.), a pressure from about 3.5 MPa (500 psig) to about 17.3 MPa (2500 psig) and a liquid hourly space velocity (LHSV) from about 0.1 to about 30 $hr^{-1}$. In accordance with the present invention, the term "substantial conversion to lower boiling products" is meant to connote the conversion of at least 5 volume percent of the fresh feedstock. In a preferred embodiment, the per pass conversion in the hydrocracking zone is in the range from about 15% to about 75%. More preferably the per pass conversion is in the range from about 20% to about 60%. Then the ratio of unconverted hydrocarbons boiling in the range of the hydrocarbonaceous feedstock to the hydrocarbonaceous feedstock is from about 1:5 to about 3:5.

During the conversions or reactions occurring in the hydrotreating and hydrocracking reaction zones, hydrogen is necessarily consumed and must be replaced by one or more hydrogen inlet points located in the reaction zones. The amount of hydrogen added at these locations is controlled to ensure that the system operates as a liquid phase continuous system. The limiting amount of hydrogen that is added is that amount which causes a transition from a liquid phase continuous system to a vapor phase continuous system.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a feed stream comprising vacuum gas oil is introduced into the process via line 1 and admixed with a hereinafter-described hydrocracking zone effluent transported via line 21. The resulting admixture is transported via line 2 and is admixed with a hydrogen-rich gaseous stream provided via line 29 in an amount sufficiently low to maintain a liquid phase continuous system and the resulting admixture is carried via line 2 and introduced into hydrotreating zone 3. The resulting effluent from the hydrotreating zone 3 is carried via line 4 and is introduced into heat-exchanger 5 and a cooled effluent stream is removed from heat-exchanger 5, carried via line 6 and introduced into vapor liquid separator 7. A gaseous stream containing hydrogen, hydrogen sulfide, ammonia and normally gaseous hydrocarbons is removed from vapor-liquid separator 7 via line 8 and recovered. A liquid hydro-carbonaceous stream is recovered from vapor-liquid separator 7 via line 9 and introduced into vapor-liquid separator 10. A gaseous stream comprising normally gaseous hydrocarbons and hydrogen is removed from vapor-liquid separator 10 via line 11 and recovered, and a liquid hydrocarbonaceous stream is moved via line 12 and introduced into fractionation zone 13. Fractionation zone 13 produces a lower boiling hydrocarbon stream via line 14, a naphtha stream via line 15, a kerosene stream via line 16, a diesel stream via line 17 and a hydrocarbonaceous stream comprising unconverted feedstock hydrocarbons via line 18. The hydrocarbonaceous stream comprising unconverted feedstock hydrocarbons is transported via line 18 and admixed with a hydrogen-rich gaseous stream provided by line 23. The amount of the hydrogen-rich gas is controlled to ensure a liquid phase continuous system. The resulting admixture is introduced into hydrocracking zone 20 via line 19. The resulting effluent from hydrocracking zone 20 is carried via line 21 as hereinabove described. A hydrogen-rich gaseous stream is introduced via line 22 and a portion is transported via lines 23 and 19, and introduced into hydrocracking zone 20. Additional hydrogen is supplied to hydrocracking zone 20 at a first location via lines 24 and 25, and at a second location via lines 26 and 27. Yet another portion of the hydrogen-rich gaseous stream is introduced into hydrotreating zone 3 via lines 24, 26, 28, 29 and 2. Additional hydrogen is supplied to hydrotreating zone 3 at a first location via lines 24, 26, 28, 30 and 31, at a second location via lines 24, 26, 28, 30, 32 and 33, and at a third location via lines 24, 26, 28, 30, 32 and 34.

The foregoing description and drawing clearly illustrate the advantages encompassed by the process of the present invention and the benefits to be afforded with the use thereof.

What is claimed:

1. A process for hydrocracking a hydrocarbonaceous feedstock which comprises:

(a) introducing a liquid phase stream comprising a hydrocarbonaceous feedstock, a liquid phase effluent from a hydrocracking zone, and a sufficiently low hydrogen concentration to maintain a liquid phase continuous system into a hydrotreating zone to produce hydrogen sulfide and ammonia and provide a first hydrocarbonaceous stream comprising hydrocarbons having a reduced level of sulfur and nitrogen;

(b) passing an effluent stream from the hydrotreating zone to a heat exchanger to cool the effluent stream;

(c) passing the cooled effluent stream to a vapor liquid separator to provide a first vapor stream comprising hydrogen sulfide and ammonia, and a second hydrocarbonaceous stream;

(d) recovering unconverted hydrocarbons boiling in the range of the hydrocarbonaceous feedstock from the second hydrocarbonaceous stream;

(e) introducing the unconverted hydrocarbons boiling in the range of the hydrocarbonaceous feedstock recovered in step (d) into the hydrocracking zone with a sufficiently low hydrogen concentration to maintain a liquid phase continuous system and (f) recovering hydrocracked hydrocarbons boiling in a temperature range lower than the hydrocarbonaceous feedstock.

2. The process of claim 1 wherein the hydrocarbonaceous feedstock boils in the range from about 315° C. (600° F.) to about 565° C. (1050° F.).

3. The process of claim 1 wherein the hydrotreating zone is operated at conditions including a temperature from about 204° C. (400° F.) to about 482° C. (900° F.) and a pressure from about 3.5 MPa (500 psig) to about 17.3 MPa (2500 psig).

4. The process of claim 1 wherein the vapor-liquid separator is operated at a pressure from about 3.5 MPa (500 psig) to about 17.3 MPa (2500 psig) and a temperature from about 15.6° C. (60° F.) to about 65° C. (150° F.).

5. The process of claim 1 wherein the ratio of the unconverted hydrocarbons boiling in the range of the hydrocarbonaceous feedstock recovered in step (e) to the hydrocarbonaceous feedstock is from about 1:5 to about 3:5.

6. The process of claim 1 wherein the recovery of the unconverted hydrocarbons boiling in the range of the hydrocarbonaceous feedstock is conducted in a fractionation zone.

7. The process of claim 1 wherein the hydrocracking zone is operated at conditions including a temperature from about 232° C. (450° F.) to about 468° C. (875° F.) and a pressure from about 3.5 MPa (500 psig) to about 17.3 MPa (2500 psig).

8. A process for hydrocracking a hydrocarbonaceous feedstock which comprises:

(a) introducing a liquid phase stream comprising a hydrocarbonaceous feedstock and a liquid phase effluent from a hydrocracking zone and a sufficiently low hydrogen concentration to maintain a liquid phase continuous system into a hydrotreating zone to produce hydrogen sulfide and ammonia, and provide a first hydrocarbonaceous stream containing hydrocarbons having a reduced level of sulfur and nitrogen;

(b) passing an effluent stream from the hydrotreating zone to a heat exchanger to partially condense the effluent stream;

(c) passing the partially condensed effluent stream to a first vapor-liquid separator to provide a first vapor steam comprising hydrogen, hydrogen sulfide and ammonia, and a second hydrocarbonaceous stream;

(d) passing the second hydrocarbonaceous stream to a second vapor-liquid separator to provide a second vapor stream comprising normally gaseous hydrocarbons and hydrogen, and a third hydrocarbonaceous stream;

(e) recovering hydrocarbons boiling in the range of the hydrocarbonaceous feedstock from the third hydrocarbonaceous stream;

(f) introducing the hydrocarbons boiling in the range of the hydrocarbonaceous feedstock recovered in step (e) into the hydrocracking zone; and (g) recovering hydrocracked hydrocarbons boiling in a temperature range less than the hydrocarbonaceous feedstock.

9. The process of claim 8 wherein the first vapor-liquid separator is operated at a pressure from about 3.5 MPa (500 psig) to about 17.3 MPa (2500 psig) and a temperature from about 15.6° C. (60° F.) to about 65° C. (150° F.).

10. The process of claim 8 wherein the second vapor-liquid separator is operated at a pressure from about 790 kPa (100 psig) to about 3500 kPa (500 psig) and a temperature from about 15.6° C. (60° F.) to about 65° C. (150° F.).

11. The process of claim 8 wherein the ratio of the unconverted hydrocarbons boiling in the range of the hydrocarbonaceous feedstock recovered in step (e) to the hydrocarbonaceous feedstock is from about 1:5 to about 3:5.

12. The process of claim 8 wherein the recovery of the unconverted hydrocarbons boiling in the range of the hydrocarbonaceous feedstock is conducted in a fractionation zone.

13. The process of claim 8 wherein the hydrocracking zone is operated at conditions including a temperature from about 232° C. (450° F.) to about 468° C. (875° F.) and a pressure from about 3.5 MPa (500 psig) to about 17.3 MPa (2500 psig).

14. A process for hydrocracking a hydrocarbonaceous feedstock which comprises:

(a) introducing a liquid phase stream comprising a hydrocarbonaceous feedstock boiling at a temperature from about 315° C. (600° F.) to about 565° C. (1050° F.) and a liquid phase effluent from a hydrocracking zone and a sufficiently low hydrogen concentration to maintain a liquid phase continuous system into a hydrotreating zone to produce hydrogen sulfide and ammonia, and provide a first hydrocarbonaceous stream containing hydrocarbons having a reduced level of sulfur and nitrogen;

(b) passing an effluent stream from the hydrotreating zone to a heat exchanger to partially condense the effluent stream;

(c) passing the partially condensed effluent stream to a first vapor liquid separator operated at a pressure from about 3.5 MPa (500 psig) to about 17.3 MPa (2500 psig) and a temperature from about 15.6° C. (60° F.) to about 65° C. (150° F.) to provide a first vapor stream comprising hydrogen, hydrogen sulfide and ammonia, and a second hydrocarbonaceous stream;

(d) passing the second hydrocarbonaceous stream to a second vapor-liquid separator operated at a pressure from about 790 kPa (100 psig) to about 3500 kPa (500 psig) and a temperature from about 15.6° C. (60° F.) to about 65° C. (150° F.) to provide a second vapor stream comprising normally gaseous hydrocarbons and hydrogen and a third hydrocarbonaceous stream;

(e) recovering hydrocarbons boiling in the range of the hydrocarbonaceous feedstock from the third hydrocarbonaceous stream;

(f) introducing the hydrocarbons boiling in the range of the hydrocarbonaceous feedstock recovered in step (e) into the hydrocracking zone; and (g) recovering hydrocracked hydrocarbons boiling in a temperature range less than the hydrocarbonaceous feedstock.

15. The process of claim 14 wherein the hydrotreating zone is operated at conditions including a temperature from about 204° C. (400° F.) to about 482° C. (900° F.) and a pressure from about 3.5 MPa (500 psig) to about 17.3 MPa (2500 psig).

16. The process of claim 14 wherein the ratio of the unconverted hydrocarbons boiling in the range of the hydrocarbonaceous feedstock recovered in step (e) to the hydrocarbonaceous feedstock is from about 1:5 to about 3:5.

17. The process of claim 14 wherein the recovery of the unconverted hydrocarbons boiling in the range of the hydrocarbonaceous feedstock is conducted in a fractionation zone.

18. The process of claim 14 wherein the hydrocracking zone is operated at conditions including a temperature from about 232° C. (450° F.) to about 468° C. (875° F.) and a pressure from about 3.5 MPa (500 psig) to about 17.3 MPa (2500 psig).

* * * * *